US006869248B1

(12) United States Patent
Threlkeld

(10) Patent No.: US 6,869,248 B1
(45) Date of Patent: Mar. 22, 2005

(54) DISABLING SYSTEM FOR USE WITH LAW ENFORCEMENT VEHICLE

(76) Inventor: Dustin C. Threlkeld, P.O. Box 452555, Grove, OK (US) 74345

( * ) Notice: Subject to any disclaimer, the term of this patent is extended or adjusted under 35 U.S.C. 154(b) by 0 days.

(21) Appl. No.: 10/733,091

(22) Filed: Dec. 12, 2003

(51) Int. Cl.[7] ..... E01F 13/12
(52) U.S. Cl. ..... 404/6
(58) Field of Search ..... 404/6, 9

(56) References Cited

U.S. PATENT DOCUMENTS 2,708,121 A 5/1955 May
2,959,396 A 11/1960 Lawrence
3,091,481 A 5/1963 Fearn
4,382,714 A 5/1983 Hutchison
4,473,948 A 10/1984 Chadwick
5,704,445 A 1/1998 Jones

*Primary Examiner*—Thomas B. Will
*Assistant Examiner*—Raymond W Addie
(74) *Attorney, Agent, or Firm*—Donald R. Schoonover

(57) ABSTRACT

A device is mounted on a law enforcement vehicle and is deployed by a law enforcement officer after the officer has pulled the law enforcement vehicle up behind a vehicle being stopped. The device has tire-piercing spikes thereon which are located adjacent to the tires of the stopped vehicle when the device is deployed. If the driver of the stopped vehicle attempts to flee, the tires of the stopped vehicle will be pierced. The device is stored beneath the law enforcement vehicle and is controlled from inside the law enforcement vehicle.

2 Claims, 3 Drawing Sheets

DISABLING SYSTEM FOR USE WITH LAW ENFORCEMENT VEHICLE

BACKGROUND OF THE INVENTION

1. Field of the Invention

The present invention relates to the general art of land vehicles, and to the particular field of accessories for land vehicles.

2. Discussion of the Related Art

During a traffic stop of a vehicle by a law enforcement officer, the officer generally pulls his car up behind the car being stopped. The officer then exits his car and approaches the stopped car. This is entirely routine. Generally, the driver of the stopped vehicle waits in his or her car to speak with the officer. Again, this is part of a routine traffic stop.

However, in some isolated instances, the driver of the stopped vehicle does not wish to speak with the officer. In some instances, the driver of the stopped car attempts to flee by driving away from the traffic stop. This can engender a high speed automobile chase which can be dangerous. Even when an officer has identified the fleeing car and may even have assistance, the fleeing car can be dangerous.

Therefore, there is a need for a means to prevent a driver of a car that has been stopped by a law enforcement officer during a traffic stop from fleeing from the law enforcement vehicle.

In order to be as safe as possible, the officer should be able to take as many precautions as possible before he exits his vehicle. This should include taking steps to prevent the stopped car from fleeing while the officer checks records and takes any other precautions which are required for traffic stops.

Therefore, there is a need for a means to prevent a car that has been stopped by a law enforcement officer during a traffic stop from fleeing from the law enforcement vehicle and which can be activated before the officer exits his vehicle.

If an officer suspects that the driver of a stopped vehicle may attempt to flee, the officer may sometimes take steps to prevent this. Presently, these steps include parking the officer's vehicle in a location with respect to the stopped vehicle which blocks movement of the stopped vehicle. However, such position may place the officer in danger as he exits his car and may locate the officer's car in a less than desirable position with respect to the stopped car and/or by-passing traffic.

Still further, it would be advantageous if the driver of a stopped car can be prevented from fleeing without endangering the officer's car. If the officer's car is blocking the path of the stopped car, the officer's car may be damaged by the stopped car if flight is attempted.

Therefore, there is a need for a means to prevent the driver of a car that has been stopped by a law enforcement officer during a traffic stop from fleeing from the law enforcement vehicle wherein the means can be activated before the officer exits his vehicle and in a manner that prevents flight of the driver of the stopped car without endangering the officer's car.

Still further, any device which can assist an officer during a traffic stop should be amenable to rapid and easy deployment. The officer must be able to focus his entire attention on the procedure associated with the stop and should not be distracted by complex or cumbersome steps required to deploy an accessory.

Therefore, there is a need for a means to prevent a driver of a car that has been stopped by a law enforcement officer during a traffic stop from fleeing from the law enforcement vehicle and which can be activated before the officer exits his vehicle and in a manner that prevents flight of the driver of the stopped car without endangering the officer's car and which is also capable of easy and rapid deployment without distracting the officer's attention from his tasks associated with the traffic stop.

PRINCIPAL OBJECTS OF THE INVENTION

It is a main object of the present invention to provide a means to prevent a car that has been stopped by a law enforcement officer during a traffic stop from fleeing from the law enforcement vehicle.

It is another object of the present invention to provide a means to prevent a driver of a car that has been stopped by a law enforcement officer during a traffic stop from fleeing from the law enforcement vehicle and which can be activated before the officer exits his vehicle.

It is another object of the present invention to provide a means to prevent a driver of a car that has been stopped by a law enforcement officer during a traffic stop from fleeing from the law enforcement vehicle wherein the means can be activated before the officer exits his vehicle and in a manner that prevents flight of the driver of the stopped car without endangering the officer's car.

It is another object of the present invention to provide a means to prevent a driver of a car that has been stopped by a law enforcement officer during a traffic stop from fleeing from the law enforcement vehicle and which can be activated before the officer exits his vehicle and in a manner that prevents flight of the driver of the stopped car without endangering the officer's car and which is also capable of easy and rapid deployment without distracting the officer's attention from his tasks associated with the traffic stop.

SUMMARY OF THE INVENTION

These, and other, objects are achieved by an accessory for use on a law enforcement vehicle which quickly places tire-piercing spikes adjacent to at least one tire of the stopped vehicle. The spikes are positioned such that should the driver of the stopped vehicle attempt to flee, the vehicle will drive over the spikes and the tire, or tires, will be flattened. The invention is thus embodied in a device for preventing a driver of an automobile from fleeing from a law enforcement vehicle after being stopped by the law enforcement vehicle and comprises a hydraulic unit adapted to be pivotally mounted on the undersurface of a law enforcement vehicle near the front end of the law enforcement vehicle, the hydraulic unit pivotally moving between a stored position and a deployed position, the hydraulic unit including a housing, a longitudinal axis of the housing, a push rod telescopingly accommodated in the housing and a wheel rotatably mounted on the push rod, the wheel being adapted to contact a ground surface adjacent to the law enforcement vehicle when the hydraulic unit is in the deployed position, the push rod being located inside the housing when the hydraulic unit is in the stored position; a biasing element connected to the push rod and biasing the push rod towards the inside of the housing; a second biasing element inside the housing; a source of fluid on the law enforcement vehicle and fluidically connected to the housing of the hydraulic unit; a tire-piercing spike unit on the hydraulic unit, the tire-piercing spike unit being movable between a stored position and a deployed position, the tire-piercing spike unit being in the deployed position when the hydraulic unit is in the deployed position, the tire-piercing spike unit including two arms having tire-piercing spikes thereon, and an actuating lever unit which movably connects each arm of the two arms to the hydraulic unit, each arm of the two arms being movable between a stored position and a deployed position, each arm of the two arms being in the deployed position when the hydraulic unit is in the deployed position; and a device control unit which includes a foot pedal located inside the law enforcement vehicle, the foot pedal being movable between a device-deploying position and a device-storing position, a lock unit on the foot pedal, a lock release in the law enforcement vehicle and connected to the lock unit, and a cable connecting the foot pedal to the housing of the hydraulic unit, the hydraulic unit being in the deployed position when the foot pedal is in the device deploying position.

The device embodying the present invention permits an officer to pull up behind a stopped vehicle and then to quickly and easily deploy the tire-piercing spikes to a location that will prevent the driver of the stopped vehicle from fleeing while the officer is otherwise occupied. The officer need not endanger himself or his vehicle to effectively prevent flight of the stopped vehicle and can do so without diverting his attention from the procedures associated with a traffic stop.

BRIEF DESCRIPTION OF THE DRAWING FIGURES

DETAILED DESCRIPTION OF THE PREFERRED EMBODIMENT

Figure 1:
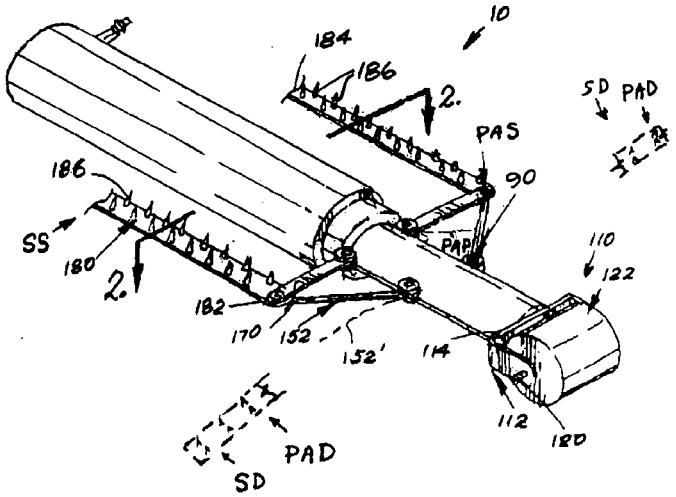
FIG. 1 is a perspective view of the device embodying the present invention.

Other objects, features and advantages of the invention will become apparent from a consideration of the following detailed description and the accompanying drawings.

Referring to the Figures, it can be understood that the present invention is embodied in an anti-escape mechanism 10 for use by law enforcement officers during a traffic stop to prevent a driver of a stopped car from fleeing. Device 10 comprises a first hollow tubular housing 12 which has a first end 14, a second end 16, and a longitudinal axis 18 which extends between the first end 14 of the first hollow tubular housing 12 and the second end 16 of the first hollow tubular housing 12. A blind-ended bore 20 is defined between the first end 14 of the first hollow tubular housing 12 and the second end 16 of the first tubular housing 12. An inner surface 22 is located adjacent to the blind-ended bore 20. The inner surface 22 of the first hollow tubular housing 12 has an internal dimension 24. Housing 12 further includes an outer surface 26 which has an outer dimension 28.

A seal element 30 is mounted on the inner surface 22 of the first hollow tubular housing 12 adjacent to the second end 16 of the first hollow tubular housing 12. An end cap 32 is on the first end 14 of the first hollow tubular housing 12.

A fluid valve 34 is mounted on the first hollow tubular housing 12 adjacent to the first end 14 of the first hollow tubular housing 12. The fluid valve 34 is in fluid communication with the blind-ended bore 20 for a purpose that will be understood from the teaching of the following disclosure.

A pivot connection element 40 (see FIG. 3) is located on the first hollow tubular housing 12 adjacent to the first end 14 of the first hollow tubular housing 12. The pivot connection element 40 is adapted to pivotally connect the first hollow tubular housing 12 to an underneath surface US of a law enforcement vehicle V. The first hollow tubular housing 12 is pivotally movable between a stored position SP with the second end 16 of the first hollow tubular housing 12 located adjacent to the underneath surface of the law enforcement vehicle and a deployed position DP, shown in solid lines in FIG. 3, with the second end 16 of the first hollow tubular housing 12 located spaced apart from the underneath surface of the law enforcement vehicle.

A second hollow tubular housing 50 includes a first end 52, a second end 54, and a longitudinal axis 56 which extends between the first end 52 of the second hollow tubular housing 50 and the second end 54 of the second hollow tubular housing 50. The longitudinal axis 56 of the second hollow housing 50 is co-linear with the longitudinal axis 18 of the first hollow tubular housing 12.

A blind-ended bore 58 is defined between the first end 52 of the second hollow tubular housing 50 and the second end 54 of the second tubular housing 50. An inner surface 60 is located adjacent to the blind-ended bore 58 of the second hollow tubular housing 50. The inner surface 60 of the second hollow tubular housing 50 has an internal dimension 62. The second housing 50 further includes an outer surface 64 which has an outer dimension 66. Outer dimension 66 of the second hollow tubular housing 50 is smaller than inner dimension 24 of the first hollow tubular housing 12. The outer surface 64 of the second hollow tubular housing 50 slidingly engages a ledge 67 on which seal element 30 is mounted adjacent to the second end 16 of the first hollow tubular housing 12.

An end cap 70 is located on the first end 52 of the second hollow tubular housing 50. End cap 70 on the first end 52 of the second hollow tubular housing 50 has fluid passages 72 defined therethrough. The fluid passages 72 of the second hollow tubular housing 50 fluidically connect blind-ended bore 20 of the first hollow tubular housing 12 to blind-ended bore 58 of the second hollow tubular housing 50.

A housing stop 74 is located on the end cap 70 of the second hollow housing 50. The housing stop 74 extends outward from the end cap 70 of the second hollow housing 50 towards the inner surface 22 of the first hollow tubular housing 12. A stop element 76 is mounted on the inner surface 60 of the second hollow tubular housing 50 adjacent to the second end 54 of the second hollow tubular housing 50.

Figure 2:
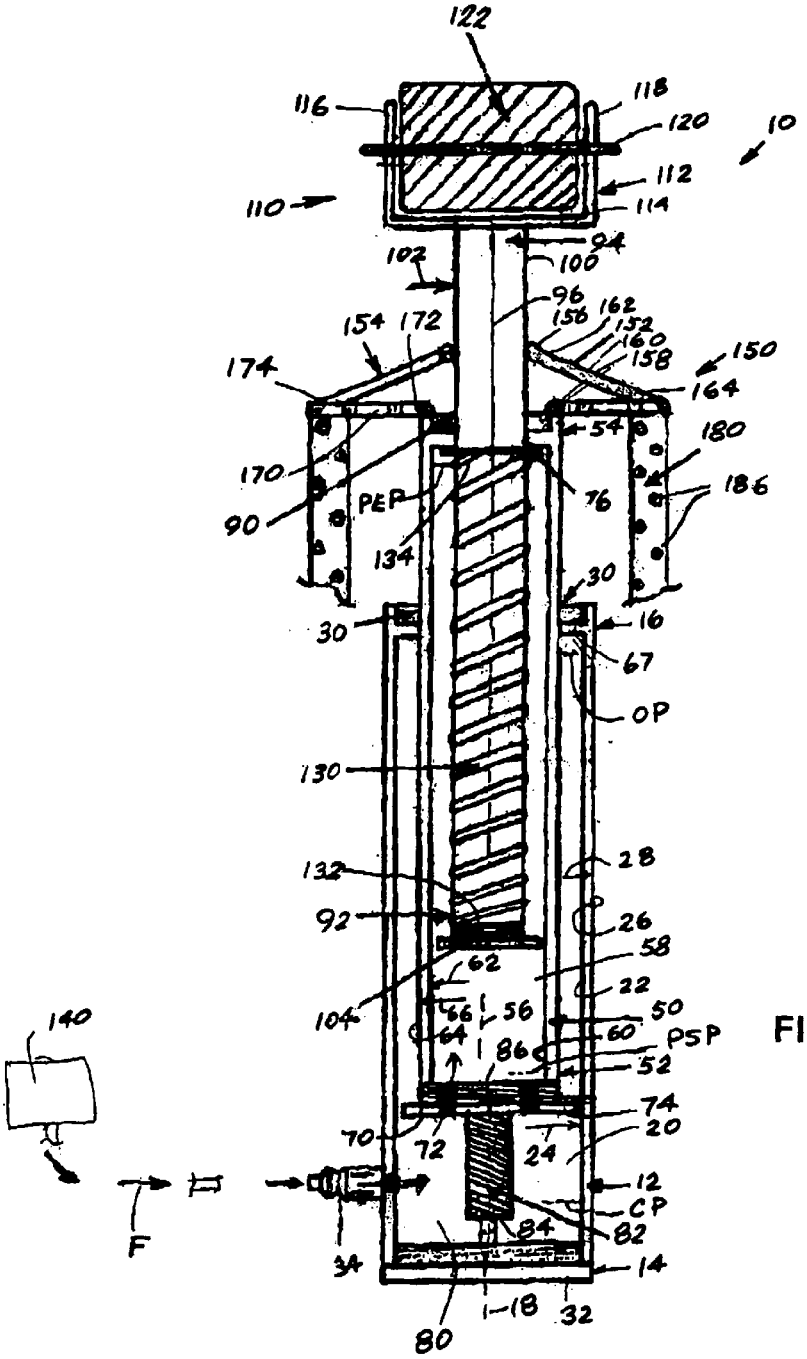
FIG. 2 is an elevational view taken along line 2—2 of FIG. 1.

The second hollow tubular housing 50 is telescopingly accommodated in the first hollow tubular housing 12 and moves between a closed position CP with the end cap 70 on the first end 52 of the second hollow tubular housing 50 located adjacent to the end cap 32 on the first end 14 of the first hollow tubular housing 12 and an open position OP, shown in FIG. 2 in solid lines, with the housing stop 74 on the end cap 70 of the second hollow housing 50 abutting the seal element 30 mounted on the inner surface 22 of the first hollow tubular housing 12 adjacent to the second end 16 of the first hollow tubular housing 12.

Device 10 further includes a fluid chamber 80 defined in the blind-ended bore 20 of the first hollow tubular housing 12 between the inner surface 22 of the first hollow tubular housing 12 and the outer surface 64 of the second hollow tubular housing 50. The fluid chamber 80 is fluidically connected to the fluid valve 34 mounted on the first hollow tubular housing 12.

A return spring 82 is mounted on the end cap 32 on the first end 14 of the first hollow tubular housing 12. The return spring 82 has a first end 84 fixed to the end cap 32 on the first end 14 of the first hollow tubular housing 12 and a second end 86 fixed to the end cap 70 on the first end 52 of the second hollow tubular housing 50. The return spring 82 biases the second hollow tubular housing 50 towards the closed position.

A push rod 90 is located in the blind-ended bore 58 of the second hollow tubular housing 50. The push rod 90 includes a first end 92, a second end 94, and a longitudinal axis 96 which extends between the first end 92 of the push rod 90 and the second end 94 of the push rod 90. Longitudinal axis 96 of the push rod 90 is co-linear with longitudinal axis 56 of the second hollow tubular housing 50.

Push rod 90 further includes an outer surface 100 which has an outer dimension 102 which is smaller than the inner dimension 62 of the second hollow tubular housing 50.

A stop element 104 is located on the first end 92 of the push rod 90. Stop element 104 extends outwardly from the outer surface 100 of the push rod 90 towards the inner surface 60 of the second hollow tubular housing 50.

Push rod 90 is telescopingly accommodated in the second hollow tubular housing 50 and moves between a stored position PSP with the end cap on the first end 92 of the push rod 90 located adjacent to the end cap 70 on the first end 52 of the second hollow tubular housing 50 and an extended position PEP with the stop on the end cap of the push rod 90 abutting the stop element 76 mounted on the inner surface 60 of the second hollow tubular housing 50 adjacent to the second end 54 of the second hollow tubular housing 50.

A wheel unit 110 is mounted on the second end 94 of the push rod 90 for movement therewith. Wheel unit 110 includes a U-shaped wheel mount 112 which has a bight section 114 fixedly mounted on the second end 94 of the push rod 90 and further includes two legs 116 and 11B attached to the bight section 114 and which extends with the push rod 90 in the direction of the longitudinal axis 96 of the push rod 90. The wheel unit 110 further includes a wheel axle 120 mounted on the legs 116, 118 of the wheel mount 112 and which extends transversely to the longitudinal axis 96 of the push rod 90.

A wheel 122 is rotatably mounted on the axle 120 to rotate around the axle 120. Wheel 122 is formed of hard rubber and is adapted to rotationally engage a ground surface GS when the push rod 90 is in the extended position and the second hollow tubular housing 50 is in the open position and the first hollow tubular housing 12 is in the deployed position.

A calibrated spring 130 encircles the push rod 90. The calibrated spring 130 has a first end 132 which contacts the stop element 104 on the first end 92 of the push rod 90 and a second end 134 which contacts stop element 76 mounted on the inner surface 60 of the second hollow tubular housing 50 adjacent to the second end 54 of the second hollow tubular housing 50. Calibrated spring 130 biases the push rod 90 towards the stored position. Calibrated spring 130 has a spring force that is greater than the spring force of return spring 82.

Figure 4:
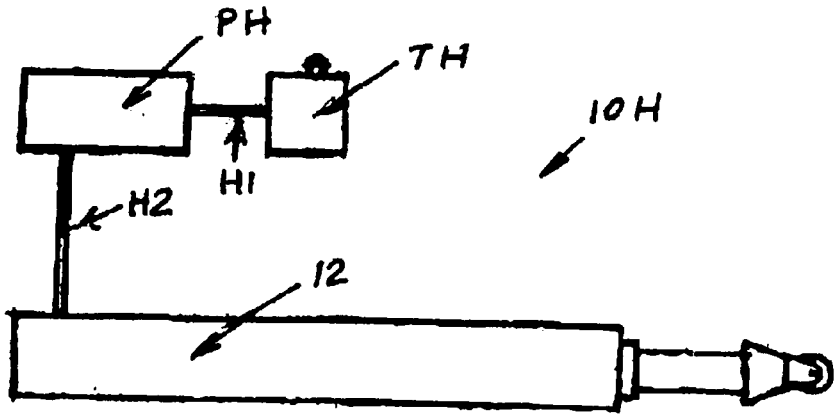
FIG. 4 illustrates a hydraulic version of the device embodying the present invention.
Figure 5:
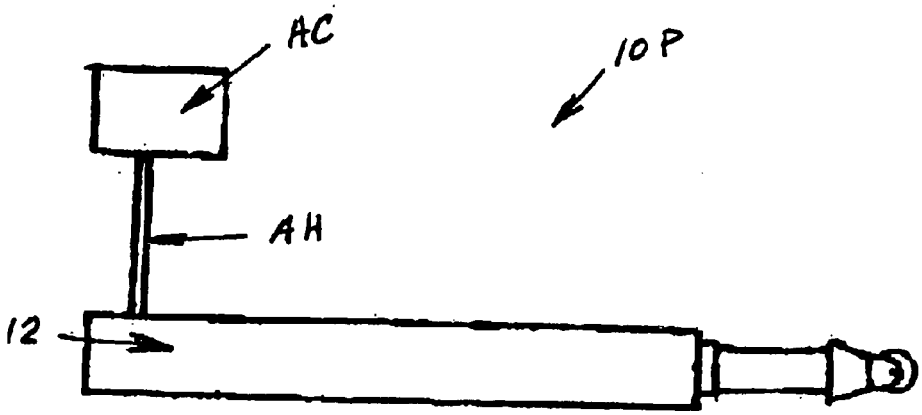
FIG. 5 illustrates a pneumatic version of the device embodying the present invention.

A source 140 of fluid is fluidically connected to the fluid valve 34 on the first hollow tubular housing 12. Source 140 of fluid has a fluid pressure which is greater than the pressure exerted on the end cap on the push rod 90 from the calibrated spring 130 and greater than the pressure exerted on the end cap 70 of the second hollow tubular housing 50 from the return spring 82. The fluid can be either hydraulic as shown in FIG. 4 as device 10H with a hydraulic fluid tank TH in the vehicle and a hydraulic pump PH also in the vehicle, which are connected together and to the housings 12, 50 via hydraulic hoses H1 and H2, or pneumatically as shown in FIG. 5 as device 10P which includes an air compressor AC fluidically connected to the housings 12, 50 by an air hose AH. Those skilled in the art will understand the fluid circuits and fluid elements needed for these systems. Accordingly, the details of such fluid circuits will not be presented in detail.

Thus, the return spring 82 is calibrated to a tension greater than the force required to pull the second hollow tubular housing 50 into a collapsed position with no pressure on the unit. The pressure calibrated spring 130 on the push rod 90 is calibrated to a tension greater than the force required to push the second hollow tubular housing 50 into the extended position, but less than the force of the created fluid pressure.

The table below is an example of the pressures which will achieve the stated purposes of device 10.

| Example (scale of 1 to 10 psi) | |
|---|---|
| Force of fluid going into the system | 10 psi |
| Force needed to pull the second housing to a collapsed position with no pressure in the system | 4 psi |
| Spring force of the return spring | 5 psi |
| Spring force of the pressure calibrated spring | 8 psi |

Thus, since the springs 82, 130 are of different spring forces, the housings 12, 50 will move when pressure is applied. The pressure going into the housings 12, 50 is greater than the forces of both springs 82, 130. The return spring 82 force is less than the inner push rod spring force, but both spring forces are less than the pressure of the fluid going into the system. Fluid flow directions are indicated in FIG. 2 by arrows F. The differential pressures and different spring forces cause the push rod and the housings 12, 50 to move relative to each other for the purpose of operating the device 10 as will be understood from the teaching of this disclosure.

Device 10 further includes a tire-piercing spike unit 150. Unit 150 includes two identical wing elements, 152 and 154. Each wing element 152, 154 includes a first pivot connection 156 mounted on the push rod 90 for movement therewith and a second pivot connection 158 mounted on the second end 54 of the second hollow tubular housing 50 for movement therewith. The first pivot connection 156 moves relative to the second pivot connection 158 as the push rod 90 moves relative to the second hollow tubular housing 50.

Each wing element 152, 154 further includes a first arm element 160 having a proximal end 162, pivotally connected to the first pivot connection 156, and a distal end 164 spaced apart from the outer surface 100 of the push rod 90. First arm element 160 is pivotally movable between a stored position, shown in FIG. 2, with the distal end 164 of the first arm element 160 located adjacent to the outer surface 100 of the push rod 90 and a deployed position indicated in FIG. 1 by dotted lines 152', with the distal end 164 of the first arm element 160 spaced apart from the outer surface 100 of the push rod 90.

A second arm element 170 has a proximal end 172, which is pivotally connected to the second pivot connection 158, and a distal end 174, which is spaced apart from the outer surface 64 of the second hollow tubular housing 50. The distal end 174 of the second arm element 170 is pivotally connected to the distal end 164 of the first arm element 160. The second arm element 170 is pivotally movable between a stored position PAS shown in solid lines in FIG. 1, with the distal end 174 of the second arm element 170 located adjacent to the outer surface 26 of the first hollow tubular housing 12 and a deployed position PAD indicated in FIG. 1 by dotted lines, with the distal end 174 of the second arm element 170 spaced apart from the outer surface 26 of the first hollow tubular housing 12.

A spiked arm 180 of each wing element 152, 154 has a proximal end 182, pivotally connected to the distal end 174 of the second arm element170, and a distal end 184. The spiked arm 180 is pivotally movable between a stored condition SS, shown in solid lines in FIG. 1, wherein the spiked arm 180 is oriented to extend in the direction of the longitudinal axis 18 of the first hollow tubular housing 12, and a stored position SD, shown in solid lines in FIG. 1, wherein the spiked arm 180 is oriented to extend transversely to the longitudinal axis 18 of the first hollow tubular housing 12. The spiked arm 180 further includes a multiplicity of tire-piercing spikes, such as tire-piercing spike 186 thereon. The spiked arm 180 is in the deployed condition when the push rod 90 is in the extended position and the second hollow tubular housing 50 is in the open position and the first hollow tubular housing 12 is in the deployed position.

Figure 3:
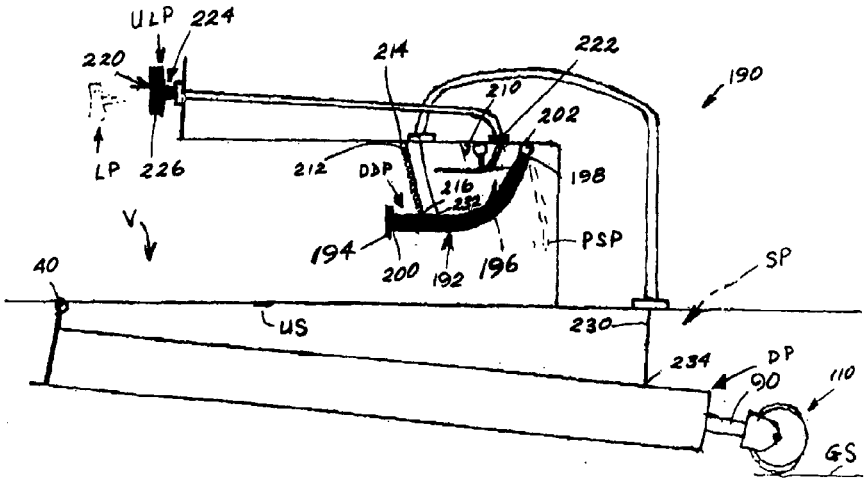
FIG. 3 shows a device control unit used in the device embodying the present invention.

A device control unit 190 is mounted on the law enforcement vehicle and is shown in FIG. 3. Unit 190 includes a foot pedal unit 192, which includes a foot pedal 194, a pedal arm 196, which has a proximal end 198 and a distal end 200 with the foot pedal 194 being mounted on the distal end 200 of the pedal arm 196. The foot pedal 194 is located inside the motor vehicle and is operated in the manner of an emergency brake.

A pivot element 202 pivotally connects the proximal end 198 of the pedal arm 196 to the law enforcement vehicle. The pedal arm 196 is pivotally movable between a device-storing position PSP, indicated in dotted lines in FIG. 3, and a device-deploying position DDP shown in solid lines in FIG. 3.

A lock unit 210 is located on the pedal arm 196 and locks the pedal arm 196 in position.

A pedal arm spring 212 has a first end 214 connected to the law enforcement vehicle and a second end 216 connected to the pedal arm 196. Pedal arm spring 212 biases the pedal arm 196 toward the device-deploying position.

A lock unit release unit 220 is movably mounted on the law enforcement vehicle and has a first end 222 connected to the lock unit 210 and a second end 224 located inside the law enforcement vehicle. The lock unit 210 is movable between a locking position LP, shown in solid lines in FIG. 3, in which the lock unit 210 is locked and an unlocking position ULP, indicated in dotted lines in FIG. 3, in which the lock unit 210 is unlocked and free to move between the device-storing position and the device-deploying position. The lock unit 210 includes a knob 226 located inside the vehicle.

A cable 230 has a proximal end 232, fixedly connected to the pedal arm 196 for movement therewith, and a distal end 234 fixedly connected to the first hollow tubular housing 12 to move the first tubular hollow housing 12 from the deployed position towards the stored position as the pedal arm 196 moves from the device-deploying position towards the device-storing position and to allow the first hollow tubular housing 12 to move towards the deployed position as the pedal arm 196 moves towards the device-deploying position.

The device control unit 190 can thus be operated in the manner of an emergency brake. The officer can release the unit using the lock unit release unit 220 without taking his eyes off the stopped vehicle or distracting his attention from the procedures associated with the traffic stop by simply pulling on the knob 226 in the manner of an emergency brake release, and can reset the unit using the foot pedal 194, again without taking his eyes off the stopped vehicle.

The device 10 embodying the present invention can include sensors that will stop deployment of the device 10 as soon as the spikes are located adjacent to the tires of the stopped vehicle. The sensors can utilize lasers or the like and will be connected to the fluid source to automatically stop fluid flow when the tire-piercing spikes reach the desired location. The tire-piercing spikes are removed after the traffic stop is completed by simply releasing the lock unit 210 using knob 226 in the manner of an emergency brake.

It is understood that while certain forms of the present invention have been illustrated and described herein, it is not to be limited to the specific forms or arrangements of parts described and shown.

What is claimed and desired to be covered by Letters Patent is as follows:

1. An anti-escape mechanism for use by law enforcement officers comprising:

a) a first hollow tubular housing having
- (1) a first end,
- (2) a second end,
- (3) a longitudinal axis extending between the first end of said first hollow tubular housing and the second end of said first hollow tubular housing,
- (4) a blind-ended bore defined between the first end of said first hollow tubular housing and the second end of said first tubular housing,
- (5) an inner surface adjacent to the blind-ended bore, the inner surface of said first hollow tubular housing having an internal dimension,
- (6) an outer surface, the outer surface of said first hollow tubular housing having an outer dimension,
- (7) a seal element ledge mounted on the inner surface of said first hollow tubular housing adjacent to the second end of said first hollow tubular housing,
- (8) a seal element mounted on the seal element ledge,
- (9) an end cap on the first end of said first hollow tubular housing,
- (10) a fluid valve mounted on said first hollow tubular housing adjacent to the first end of said first hollow tubular housing, the fluid valve being in fluid communication with the blind-ended bore, and
- (11) a pivot connection element on said first hollow tubular housing adjacent to the first end of said first hollow tubular housing, the pivot connection element being adapted to pivotally connect said first hollow tubular housing to an underneath surface of a law enforcement vehicle, said first hollow tubular housing being pivotally movable between a stored position with the second end of said first hollow tubular housing located adjacent to the underneath surface of the law enforcement vehicle and a deployed position with the second end of said first hollow tubular housing located spaced apart from the underneath surface of the law enforcement vehicle;

b) a second hollow tubular housing
- (1) a first end,
- (2) a second end,
- (3) a longitudinal axis extending between the first end of said second hollow tubular housing and the second end of said second hollow tubular housing, the longitudinal axis of said second hollow housing being co-linear with the longitudinal axis of said first hollow tubular housing,
- (4) a blind-ended bore defined between the first end of said second hollow tubular housing and the second end of said second tubular housing,
- (5) an inner surface adjacent to the blind-ended bore of said second hollow tubular housing, the inner surface of said second hollow tubular housing having an internal dimension,
- (6) an outer surface, the outer surface of said second hollow tubular housing having an outer dimension, the outer dimension of said second hollow tubular housing being smaller than the inner dimension of said first hollow tubular housing,
- (7) the outer surface of said second hollow tubular housing slidingly engaging the seal element mounted on the inner surface of said first hollow tubular housing adjacent to the second end of said first hollow tubular housing, (8) an end cap on the first end of said second hollow tubular housing, the end cap on the first end of said second hollow tubular housing having a fluid passage therethrough, the fluid passage of said second hollow tubular housing fluidically connecting the blind-ended bore of said first hollow tubular housing to the blind-ended bore of said second hollow tubular housing, (9) a housing stop on the end cap of said second hollow housing, the housing stop extending outward from the end cap of said second hollow housing towards the inner surface of said first hollow tubular housing,

(10) a stop element mounted on the inner surface of said second hollow tubular housing adjacent to the second end of said second hollow tubular housing, and

(11) said second hollow tubular housing being telescopingly accommodated in said first hollow tubular housing and moving between a closed position with the end cap on the first end of said second hollow tubular housing being located adjacent to the end cap on the first end of said first hollow tubular housing and an open position with the housing stop on the end cap of said second hollow housing abutting the seal element mounted on the inner surface of said first hollow tubular housing adjacent to the second end of said first hollow tubular housing;

c) a fluid chamber defined in the blind-ended bore of said first hollow tubular housing between the inner surface of said first hollow tubular housing and the outer surface of said second hollow tubular housing, said fluid chamber being fluidically connected to the fluid valve mounted on said first hollow tubular housing;

d) a return spring mounted on the end cap on the first end of said first hollow tubular housing, said return spring having a first end fixed to the end cap on the first end of said first hollow tubular housing and a second end fixed to the end cap on the first end of said second hollow tubular housing, said return spring biasing said second hollow tubular housing towards the closed position;

e) a push rod located in the blind-ended bore of said second hollow tubular housing, the push rod including (1) a first end, (2) a second end, (3) a longitudinal axis extending between the first end of said push rod and the second end of said push rod, the longitudinal axis of said push rod being co-linear with the longitudinal axis of said second hollow tubular housing, (4) an outer surface having an outer dimension which is smaller than the inner dimension of said second hollow tubular housing, (5) a stop element on the first end of said push rod, the stop element on the first end of said push rod extending outwardly from the outer surface of said push rod towards the inner surface of said second hollow tubular housing, and (6) said push rod being telescopingly accommodated in said second hollow tubular housing and moving between a stored position with the end cap on the first end of said push rod being located adjacent to the end cap on the first end of said second hollow tubular housing and an extended position with the stop on the end cap of said push rod abutting the stop element mounted on the inner surface of said second hollow tubular housing adjacent to the second end of said second hollow tubular housing;

f) a wheel unit mounted on the second end of said push rod for movement therewith, said wheel unit including (1) a U-shaped wheel mount having a bight section fixedly mounted on the second end of said push rod, two legs attached to the bight section and extending with said push rod in the direction of the longitudinal axis of said push rod, a wheel axle mounted on the legs of the wheel mount and extending transverse to the longitudinal axis of said push rod, and (2) a wheel rotatably mounted on the axle to rotate around the axle, the wheel being adapted to rotationally engage a ground surface when said push rod is in the extended position and said second hollow tubular housing is in the open position and said first hollow tubular housing is in the deployed position;

g) a calibrated spring encircling said push rod, said calibrated spring having a first end contacting the stop element on the first end of said push rod and a second end contacting the stop element mounted on the inner surface of said second hollow tubular housing adjacent to the second end of said second hollow tubular housing, said calibrated spring biasing said push rod towards the stored position, the calibrated spring having a spring force that is greater than the spring force of the return spring;

h) a source of fluid fluidically connected to the fluid valve on said first hollow tubular housing, said source of fluid having a fluid pressure greater than the pressure exerted on the end cap on said push rod from the calibrated spring and greater than the pressure exerted on the end cap of said second hollow tubular housing from the return spring;

i) a tire-piercing spike unit which includes two identical wing elements, each wing element including (1) a first pivot connection mounted on said push rod for movement therewith, (2) a second pivot connection mounted on the second end of said second hollow tubular housing for movement therewith, said first pivot connection moving relative to the second pivot connection as said push rod moves relative to said second hollow tubular housing, (3) a first arm element having a proximal end pivotally connected to said first pivot connection and a distal end spaced apart from the outer surface of said push rod, the first arm element being pivotally movable between a stored position with the distal end of the first arm element located adjacent to the outer surface of said push rod and a deployed position with the distal end of the first arm element spaced apart from the outer surface of said push rod, (4) a second arm element having a proximal end pivotally connected to said second pivot connection and a distal end spaced apart from the outer surface of said second hollow tubular housing, the distal end of the second arm element being pivotally connected to the distal end of the first arm element, the second arm element being pivotally movable between a stored position with the distal end of the second arm element located adjacent to the outer surface of said first hollow tubular housing and a deployed position with the distal end of the second arm element spaced apart from the outer surface of said first hollow tubular housing, and (5) a spiked arm having a proximal end pivotally connected to the distal end of the second arm element and a distal end, the spiked arm being pivotally movable between a stored condition in which the spiked arm is oriented to extend in the direction of the longitudinal axis of said first hollow tubular housing and a deployed position in which the spiked arm is oriented to extend transverse to the longitudinal axis of said first hollow tubular housing, the spiked arm further including a multiplicity of tire-piercing spikes thereon, the spiked arm being in the deployed condition when said push rod is in the extended position and said second hollow tubular housing is in the open position and said first hollow tubular housing is in the deployed position; and j) a device control unit mounted on the law enforcement vehicle and including (1) a foot pedal unit which includes (A) a foot pedal, (B) a pedal arm having a proximal end and a distal end, the foot pedal being mounted on the distal end of the pedal arm, (C) a pivot element pivotally connecting the proximal end of the pedal arm to the law enforcement vehicle, the pedal arm being pivotally movable between a device-storing position and a device-deploying position, (D) a lock unit on the pedal arm which locks the pedal arm in position, (E) a pedal arm spring having a first end connected to the law enforcement vehicle and a second end connected to the pedal arm, the pedal arm spring biasing the pedal arm toward the device deploying position, (F) lock unit release unit movably mounted on the law enforcement vehicle and having a first end connected to the lock unit and a second end located inside the law enforcement vehicle, the lock unit being movable between a locking position in which the lock unit is locked and an unlocking position in which the lock unit is unlocked and free to move between the device-storing position and the device-deploying position, and (G) a cable having a proximal end fixedly connected to the pedal arm for movement therewith and a distal end fixedly connected to said first hollow tubular housing to move said first tubular hollow housing from the deployed position towards the stored position as the pedal arm moves from the device deploying position towards the device-storing position and to allow said first hollow tubular housing to move towards the deployed position as the pedal arm moves towards the device-deploying position.

2. A device for preventing an automobile from fleeing from a law enforcement vehicle after being stopped by the law enforcement vehicle comprising:

a) a hydraulic unit adapted to be pivotally mounted on the undersurface of a law enforcement vehicle near the front end of the law enforcement vehicle, said hydraulic unit pivotally moving between a stored position and a deployed position, said hydraulic unit including a housing, a longitudinal axis of the housing, a push rod telescopingly accommodated in the housing and a wheel rotatably mounted on the push rod, the wheel being adapted to contact a ground surface adjacent to the law enforcement vehicle when said hydraulic unit is in the deployed position, the push rod being located inside the housing when the hydraulic unit is in the stored position;

b) a biasing element connected to the push rod and biasing the push rod towards the inside of the housing;

c) a second biasing element inside the housing;

d) a source of fluid on the law enforcement vehicle and fluidically connected to the housing of said hydraulic unit;

e) a tire-piercing spike unit on said hydraulic unit, said tire-piercing spike unit being movable between a stored position and a deployed position, the tire-piercing spike unit being in the deployed position when said hydraulic unit is in the deployed position, said tire-piercing spike unit including (1) two arms having tire-piercing spikes thereon, and (2) an actuating lever unit movably connecting each arm of the two arms to said hydraulic unit, each arm of the two arms being movable between a stored position and a deployed position, each arm of the two arms being in the deployed position when said hydraulic unit is in the deployed position; and f) a device control unit which includes (1) a foot pedal located inside the law enforcement vehicle, the foot pedal being movable between a device-deploying position and a device-storing position, (2) a lock unit on the foot pedal, (3) a lock release in the law enforcement vehicle and connected to the lock unit, and (4) a cable connecting the foot pedal to the housing of said hydraulic unit, said hydraulic unit being in the deployed position when the foot pedal is in the device-deploying position.

* * * * *